US006830320B2

(12) United States Patent
Hawkins et al.

(10) Patent No.: US 6,830,320 B2
(45) Date of Patent: Dec. 14, 2004

(54) CONTINUOUS STREAM INK JET PRINTER WITH MECHANISM FOR ASYMMETRIC HEAT DEFLECTION AT REDUCED INK TEMPERATURE AND METHOD OF OPERATION THEREOF

(75) Inventors: Gilbert A. Hawkins, Mendon, NY (US); James M. Chwalek, Pittsford, NY (US); David P. Trauernicht, Rochester, NY (US); Christopher N. Delametter, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 29 days.

(21) Appl. No.: 10/131,294

(22) Filed: Apr. 24, 2002

(65) Prior Publication Data

US 2003/0202053 A1 Oct. 30, 2003

(51) Int. Cl.[7] ..... B41J 2/09
(52) U.S. Cl. ..... 347/77
(58) Field of Search ..... 347/18, 223, 73–77, 347/81, 82, 90, 92, 65, 7, 6; 101/451; 523/160

(56) References Cited

U.S. PATENT DOCUMENTS 3,878,519 A * 4/1975 Eaton ..... 347/75
4,176,605 A * 12/1979 Yoshida et al. ..... 101/451
4,310,846 A * 1/1982 Horike ..... 347/6
4,340,895 A * 7/1982 Kikuchi ..... 347/92
4,555,712 A * 11/1985 Arway et al. ..... 347/7
5,001,497 A 3/1991 Wills et al.
5,623,292 A 4/1997 Shrivastava et al.
6,019,457 A * 2/2000 Silverbrook ..... 347/65
6,079,821 A 6/2000 Chwalek et al. ..... 347/82
6,247,801 B1 6/2001 Trauernicht et al. ..... 347/74
6,350,021 B1 * 2/2002 Gray et al. ..... 347/78
6,364,457 B1 4/2002 Keur et al.
6,414,051 B1 * 7/2002 Goodbrand et al. ..... 523/160
6,517,197 B2 * 2/2003 Hawkins et al. ..... 347/74
6,588,888 B2 * 7/2003 Jeanmaire et al. ..... 347/77

FOREIGN PATENT DOCUMENTS

| | | |
|---|---|---|
| EP | 1016526 | 7/2000 |
| EP | 1142718 | 10/2001 |
| WO | WO 97/30850 | 8/1997 |

* cited by examiner

*Primary Examiner*—K. Feggins
(74) *Attorney, Agent, or Firm*—William R. Zimmerli

(57) ABSTRACT

A continuous stream ink jet printer including a printhead having at least one nozzle or continuously ejecting a stream of ink droplets. A heater disposed adjacent to the nozzle thermally deflects selected ink droplets by asymmetrically heating the ink droplets to effect a printing operation. A cooling unit cools the ink provided to the printhead nozzle to increase the deflection angle of the droplets.

20 Claims, 10 Drawing Sheets

CONTINUOUS STREAM INK JET PRINTER WITH MECHANISM FOR ASYMMETRIC HEAT DEFLECTION AT REDUCED INK TEMPERATURE AND METHOD OF OPERATION THEREOF

FIELD OF THE INVENTION

The present invention relates generally to ink jet printers, and more particularly to a method and apparatus for improving the performance of continuous stream ink jet printers which deflect ink droplets through asymmetric heating thereof.

BACKGROUND OF TH INVENTION

Traditionally, color ink jet printing is accomplished by one of two technologies referred to as "drop-on-demand" and "continuous stream" printing. In each case, ink is fed through channels formed in a printhead. Each channel includes a nozzle from which droplets of ink are ejected and deposited upon a medium. Typically, each technology requires separate ink supply and delivery systems for each ink color used in printing. Ordinarily, the three primary subtractive colors, i.e. cyan, yellow and magenta, are used because these colors can produce up to several million perceived color combinations.

In drop-on-demand ink jet printing, ink droplets are selectively ejected for impact upon a print medium using a pressurization actuator (thermal, piezoelectric, etc.). Selective activation of the actuator causes the formation and ejection of an ink droplet that crosses the space between the printhead and the print medium and strikes the print medium. The formation of printed images is achieved by controlling the individual formation of ink droplets as the medium is moved relative to the printhead. Typically, a slight negative pressure within each channel keeps the ink from inadvertently escaping through the nozzle, and also forms a slightly concave meniscus at the nozzle, thus helping to keep the nozzle clean.

Typically, either heat actuators or piezoelectric actuators are used as pressurization actuators. With heat actuators, a heater heats the ink causing a quantity of ink to phase change into a gaseous steam bubble that raises the internal ink pressure sufficiently for an ink droplet to be expelled. With piezoelectric actuators, an electric potential is applied to a piezoelectric material possessing properties that create a pulse of mechanical movement stress in the material causing an ink droplet to be expelled by a pumping action. The most commonly produced piezoelectric materials are ceramics, such as lead zirconate titanate, barium titanate, lead titanate, and lead metaniobate.

The second technology, commonly referred to as "continuous stream" or "continuous ink jet" printing, uses a pressurized ink source for producing a continuous stream of ink droplets. The droplets are then selectively deflected to either strike the print medium or not. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or disposed of. When print is desired, the ink droplets are not deflected and allowed to strike a print media. Alternatively, deflected ink droplets may be allowed to strike the print media, while non-deflected ink droplets are collected in the ink capturing mechanism. Typically, continuous ink jet printing devices are faster than droplet on demand devices.

U.S. Pat. No. 6,079,821 discloses a continuous stream ink jet printer in which periodic heat pulses are applied to the ink filament to break the filament into droplets. Droplets can be deflected, either into a reservoir or onto a print medium by selective actuation of one or more of plural heater sections disposed around an ejection nozzle. In other words, selective deflection is accomplished by asymmetrically heating the ink droplets to create a temperature gradient within the droplets.

Asymmetrically applied heat results in droplet deflection having a magnitude, i.e. angle, that depends on several factors. For example, the geometric and thermal properties of the nozzle, the quantity and differential of applied heat, the ink pressure, and thermal properties of the ink all affect deflection angle. Of course, the greater the deflection angle of the ink drops, the more reliable, compact, and accurate the printer can be. The thermal properties of ink can be adjusted to some extent. However, in order to maintain compatibility with a plurality of available inks, it is desirable for a printer to be capable of using standard ink compositions. Also, it is difficult to impart a great deal of heat to the ink stream in an asymmetrical manner, i.e., to create a large temperature gradient, because of the relatively high rate of heat conduction in the ink and the relatively small dimensions of typical ink flow channels and nozzles. Accordingly, complex heater and nozzle arrangements have been developed to improve deflection angles of ink droplets in continuous stream printers.

Commonly assigned U.S. Pat. No. 6,247,801 discloses an arrangement for asymmetric heating of ink droplets in continuous ink jet printers.

SUMMARY OF THE INVENTION

It is an object of the invention to improve printing consistency in an ink jet printer. To achieve this object and other objects, a first aspect of the invention is a continuous stream ink jet printer, comprising a printhead having at least one nozzle having an axis for continuously ejecting a stream of ink droplets an ink supply for providing liquid ink to the printhead, a heater disposed adjacent the nozzle for generating heat that thermally deflects selected ink droplets at an angle with respect to the axis to effect a printing operation, and a cooling unit for cooling ink provided to the printhead to increase the deflection angle of the droplets.

A second aspect of the invention is a method of printing with a continuous ink jet printer comprising cooling ink to a temperature lower than an ambient temperature, ejecting the ink as a filament out of a nozzle along an axis, breaking the filament up into droplets, and wherein the ink is asymmetrically heated to selectively deflect the droplets off of the axis.

BRIEF DESCRIPTION OF THE DRAWINGS

Other features and advantages of the present invention will become apparent from the following description of the preferred embodiments of the invention, and the accompanying drawings, wherein.

DETAILED DESCRIPTION OF THE INVENTION

Figure 1:
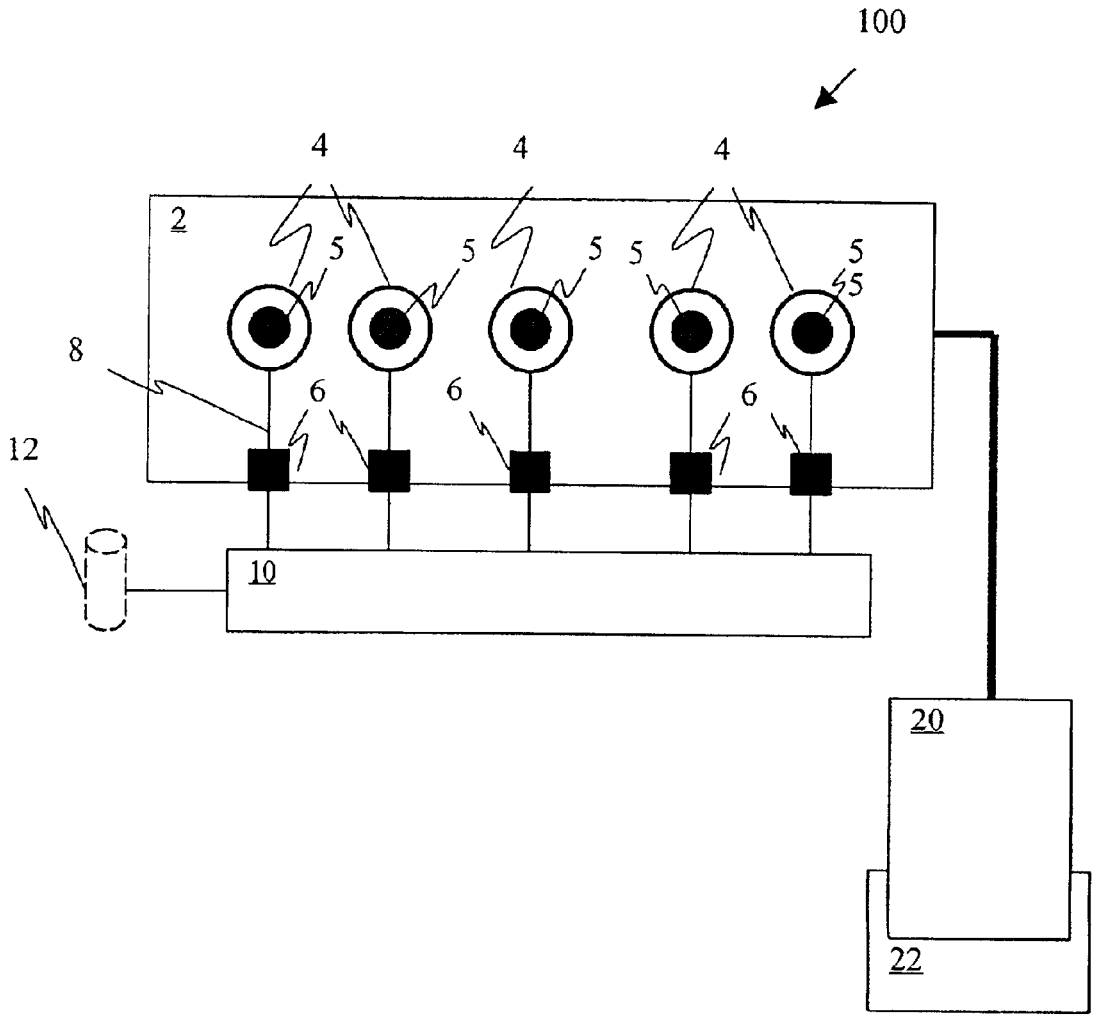
FIG. 1 is a schematic diagram of a printing apparatus of the preferred embodiment.
Figure 2:
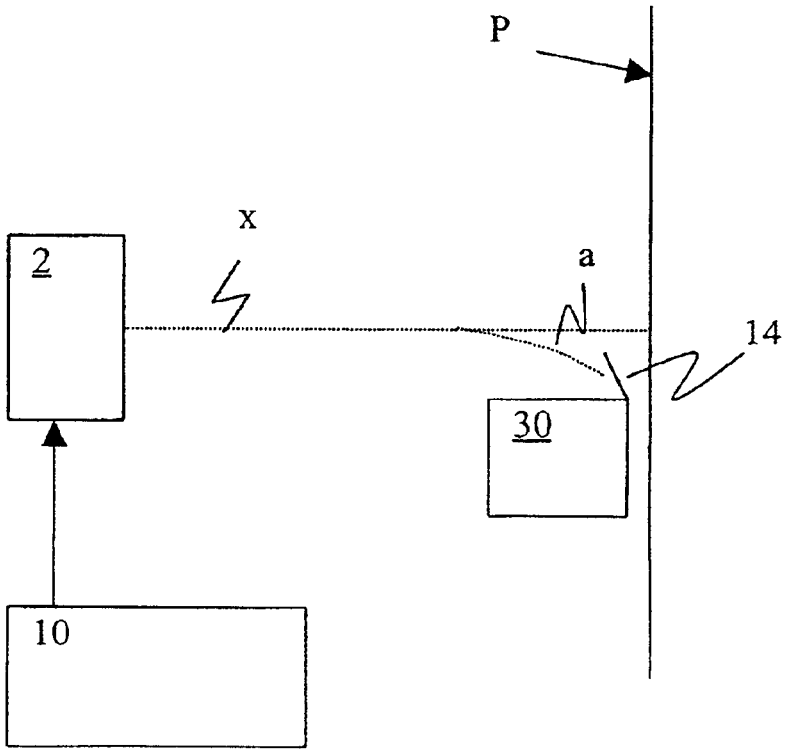
FIG. 2 is a schematic side view of portions of the printing apparatus of FIG. 1.

FIGS. 1 and 2 illustrate the continuous stream printer apparatus 100 of the preferred embodiment. Printhead 2 is formed from a semiconductor material, e.g., silicon, using known semiconductor fabrication techniques, e.g., CMOS circuit fabrication techniques, micro-electro mechanical structure (MEMS) fabrication techniques, or the like. However, printhead 2 may be formed from any materials using any fabrication techniques conventionally known in the art.

As illustrated in FIG. 1, a plurality of annular heaters 4 are positioned on the printhead 2 around corresponding nozzles 5 formed in printhead 2. Although each heater 4 may be disposed radially away from an edge of a corresponding nozzles 5, heaters 4 are preferably disposed close to corresponding nozzles 5 in a concentric manner. In the preferred embodiment, heaters 4 are formed in a substantially circular or ring shape. However, heaters 4 may be formed in a partial ring, square, or other shape. Each heater 4 in the preferred embodiment is principally comprised of at least one resistive heating element electrically connected to contact pads 6 via conductors 8. As will become apparent from the description of heaters 4 below, contact pads, 6 can each comprise plural contacts and conductors 8 can each comprise plural conductors.

Each nozzle 5 is in fluid communication with ink supply 20 through an ink passage (not shown) also formed in printhead 2. Printhead 2 may incorporate additional ink supplies in the same manner as ink supply 20 as well as additional corresponding nozzles 5 in order to provide color printing using three or more ink colors. Additionally, black and white or single color printing may be accomplished using a single ink supply 20 and nozzle 5.

Conductors 8 and electrical contact pads 6 may be at least partially formed or positioned on the printhead 2 and provide electrical connections between controller 10 and heaters 4. Alternatively, the electrical connection between controller 10 and heater 4 may be accomplished in any known manner. Controller 10 may be a relatively simple device (a switchable power supply for heaters 4, etc.) or a relatively complex device (a logic controller or programmable microprocessor in combination with a power supply temperature) operable to control heaters 4 or any other components of printer apparatus 100 in a desired manner. Temperature sensor 12 can be disposed in the ink flow path to provide ink temperature data to controller 10.

Activation of heaters 4 will cause a filament of ink ejected out of the corresponding nozzle 5 to be broken into droplets in a known manner. As illustrated in FIG. 2, droplets can be selectively directed to paper P as a print medium or into reservoir 30 for disposal or reuse by being selectively deflected off of axis x though angle a. Such deflection can be accomplished in a known manner. Note that deflection generally begins to occur as soon as the droplet leaves the nozzle. However, angle a is illustrated as being remote from the nozzle for clarity. For example, the activation signal supplied to heater 4 can be controlled to approximate a series of pulses, as described below. For example, U.S. Pat. No. 6,079,821 discloses how heat pulses can be applied to an ink filament to break the filament into droplets.

Figure 3:
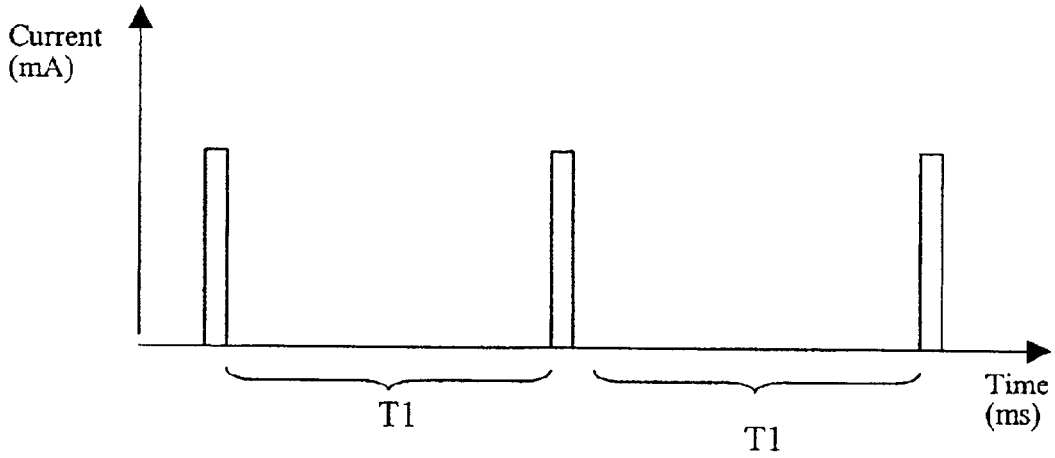
FIG. 3 is a graph of amplitude versus time of heat activation pulses for controlling droplet size.
Figure 4:
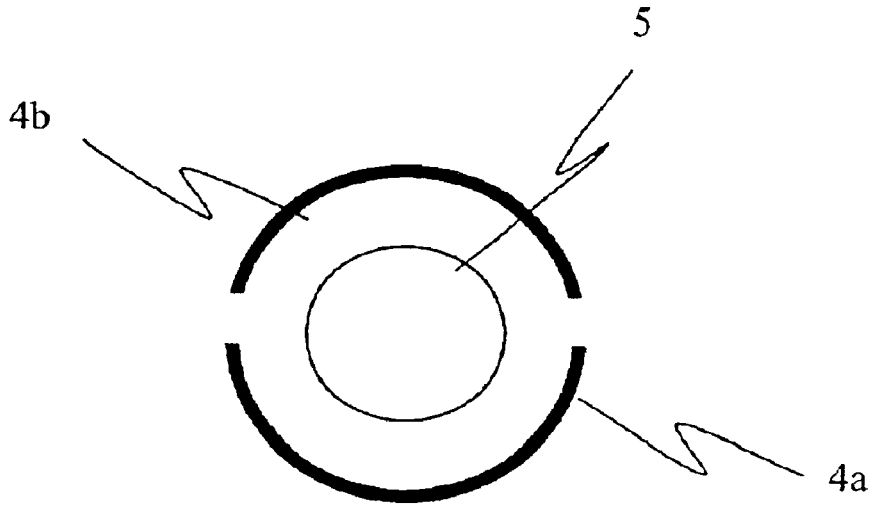
FIG. 4 illustrates one heater of the preferred embodiment.

As illustrated in FIG. 3, heater activation pulses, e.g., electrical pulses in the case of an electric resistance heating element, can be used to create heat pulses having a time period of T1 therebetween. As disclosed in U.S. Pat. No. 6,079,821, a heater having plural sections, two sections for example, can be used to asymmetrically heat the droplets, formed from the ink filament to thereby deflect the droplets in a selective manner. As illustrated in FIG. 4, heater 4 of the preferred embodiment includes two heater elements 4*a* and 4*b* that can be controlled independently. One element can be activated alone to imput a temperature gradient to ink droplets. Separate electrical connections can be used to couple heater elements 4*a* and 4*b* to controller 10 to permit the magnitude of activation pulses provided to heater elements 4*a* and 4*b* to be different to thereby asymmetrically heat the droplet formed in the manner described above. The asymmetric heating can be selective, i.e., carried in a predetermined manner, to selectively deflect droplets off of axis x and into reservoir 30. Undeflected droplets can impinge on paper P to form a delivered image as paper P is moved relative to printhead 2 in a known manner. Alternatively, only one heater element, disposed asymmetrically about nozzle 5, is required.

The degree of deflection off of axis x is substantially proportional to the difference in temperature across the droplet, i.e., the droplet temperature gradient. Of course, the greater the deflection, the less precise tolerances of the system of the system need to be. Accordingly, it is desirable to maximize the angle of droplet deflection. However, it is also important to precisely control the temperature gradient in the ink droplet to insure accurate deflection and thus printing. Further, ambient temperature changes can affect the temperature gradient in the ink droplets.

Common practice is to heat the ink to a temperature that is high enough to minimize the effects of ambient temperature changes on the ink droplet temperature gradient. However, applicant has found that, for a given temperature gradient in the ink droplet, maximum deflection is achieved at reduced ink temperatures. Accordingly, known devices do not achieve maximum deflection.

Figure 5:
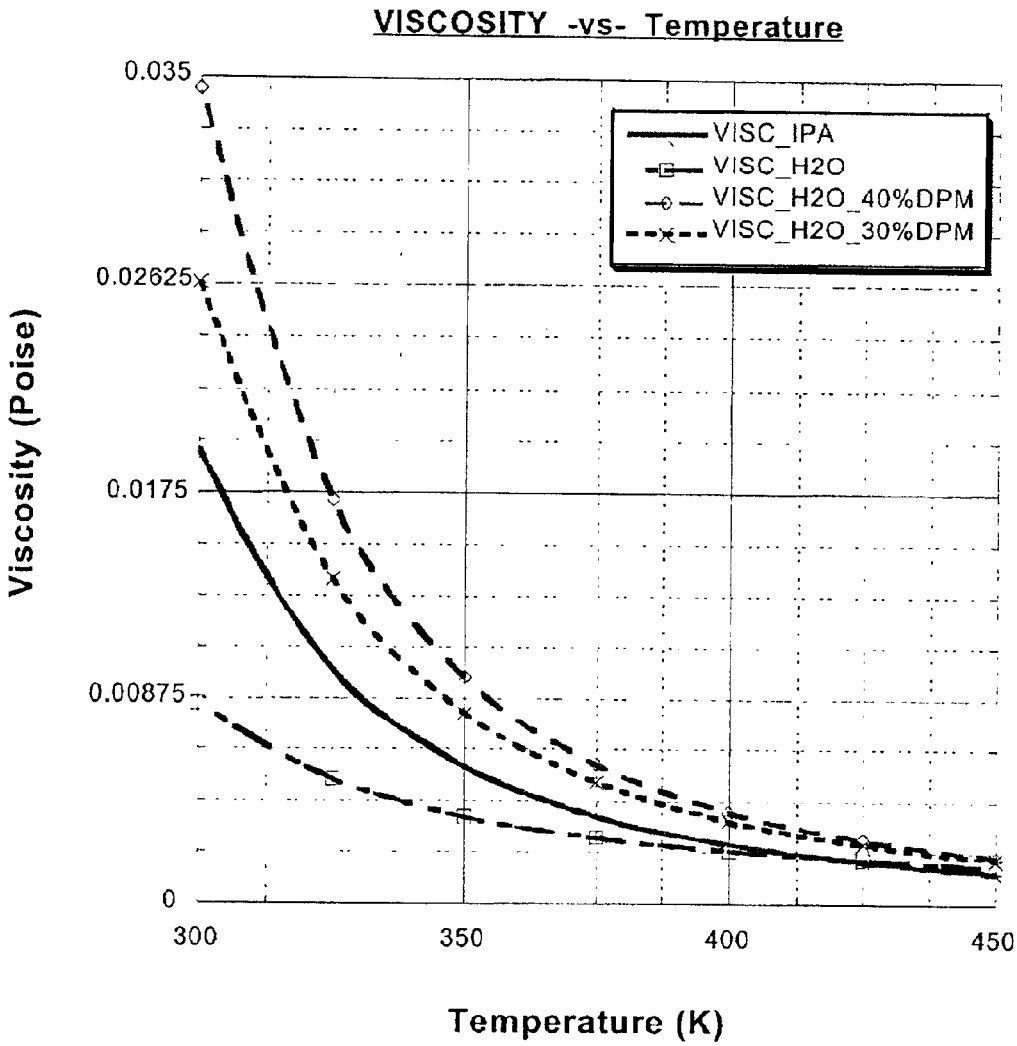
FIG. 5 is a graph of viscosity versus temperature for plural ink compositions.

FIG. 5 is a graph of viscosity versus temperature for four common ink compositions using either isopropyl alcohol or water as a solvent. It can be seen that viscosity increases with a decrease in temperature for all four ink compositions. Further, complex computational fluid dynamics reveal that deflection is roughly proportional to the slope of the viscosity versus temperature curve. In particular, a lower viscosity results in an increase in fluid velocity and this lower viscosity portions of ink flow provide greater momentum to the ink flow. Accordingly, a larger viscosity gradient across the ink in the nozzle results in greater deflection. It can be seen that the slope of each curve in FIG. 5 increases at reduced temperatures.

Figure 6:
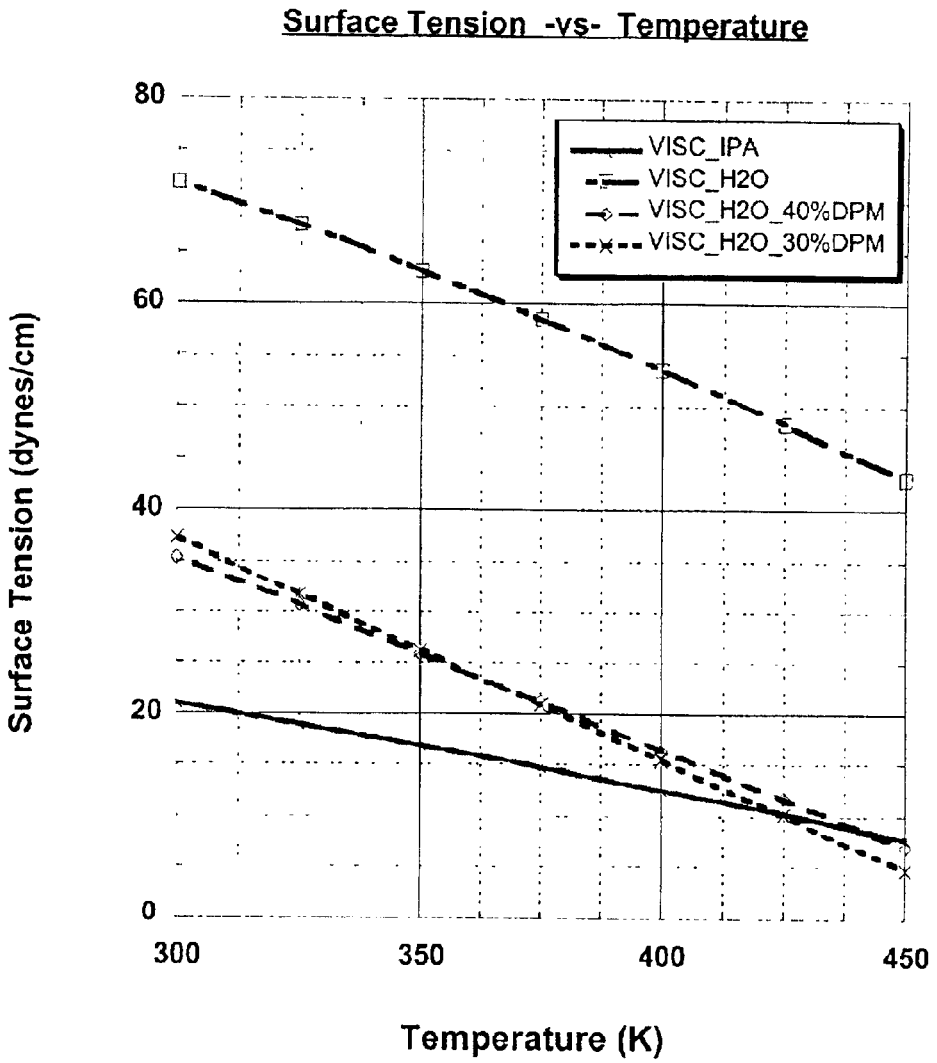
FIG. 6 is a graph of surface tension versus temperature for the same ink compositions.

Computational fluid dynamics also shows that the surface tension of ink contributes to ink droplet deflection in a manner that opposes the viscosity contribution. A higher surface tension tends to reduce deflection. In particular, surface tension acts as a restorative "spring" to oppose deflection. FIG. 6 is a graph of surface tension versus temperature for the same four ink compositions. It can be seen that surface tension increases as temperature decreases. Therefore a decrease in temperature results in a surface tension component that tends to reduce deflection angle. However, since the increase in surface tension with reduced temperature is linear, the surface tension component does not increase as much as the viscosity component which increases in substantially an exponential form with decreasing temperature. Therefore, the effect of surface tension on reducing deflection is not as great as the effect of viscosity in increasing deflection at lower temperatures.

Figure 7:
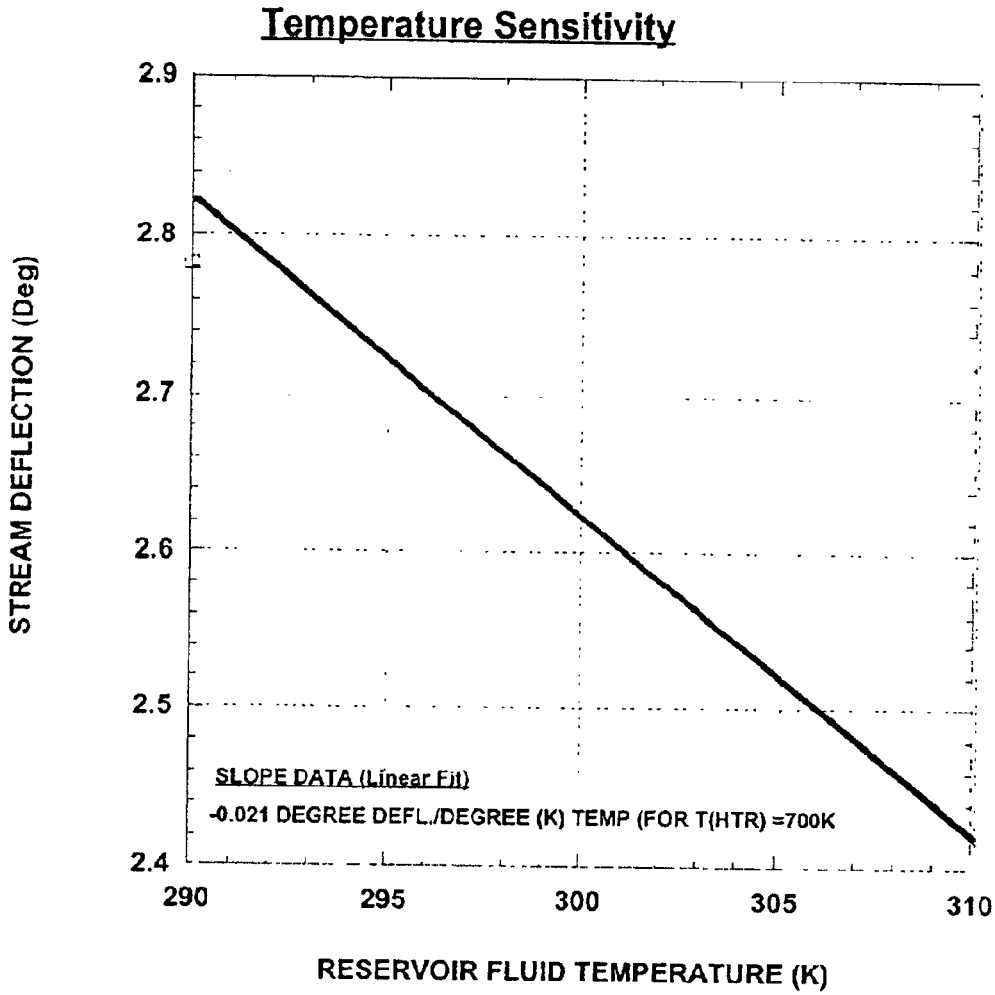
FIG. 7 is a graph of ink droplet deflections versus ink reservoir temperature.

FIG. 7 is a graph of droplet deflection angle versus temperature of ink the ink supply using a 10 micron slot width print nozzle and water based ink. The curve corresponds to a heater element having an activated temperature of 700K. It can be seen that, as temperature of ink in the ink supply 20 is reduced, deflection angle increases in a linear fashion.

Figure 8:
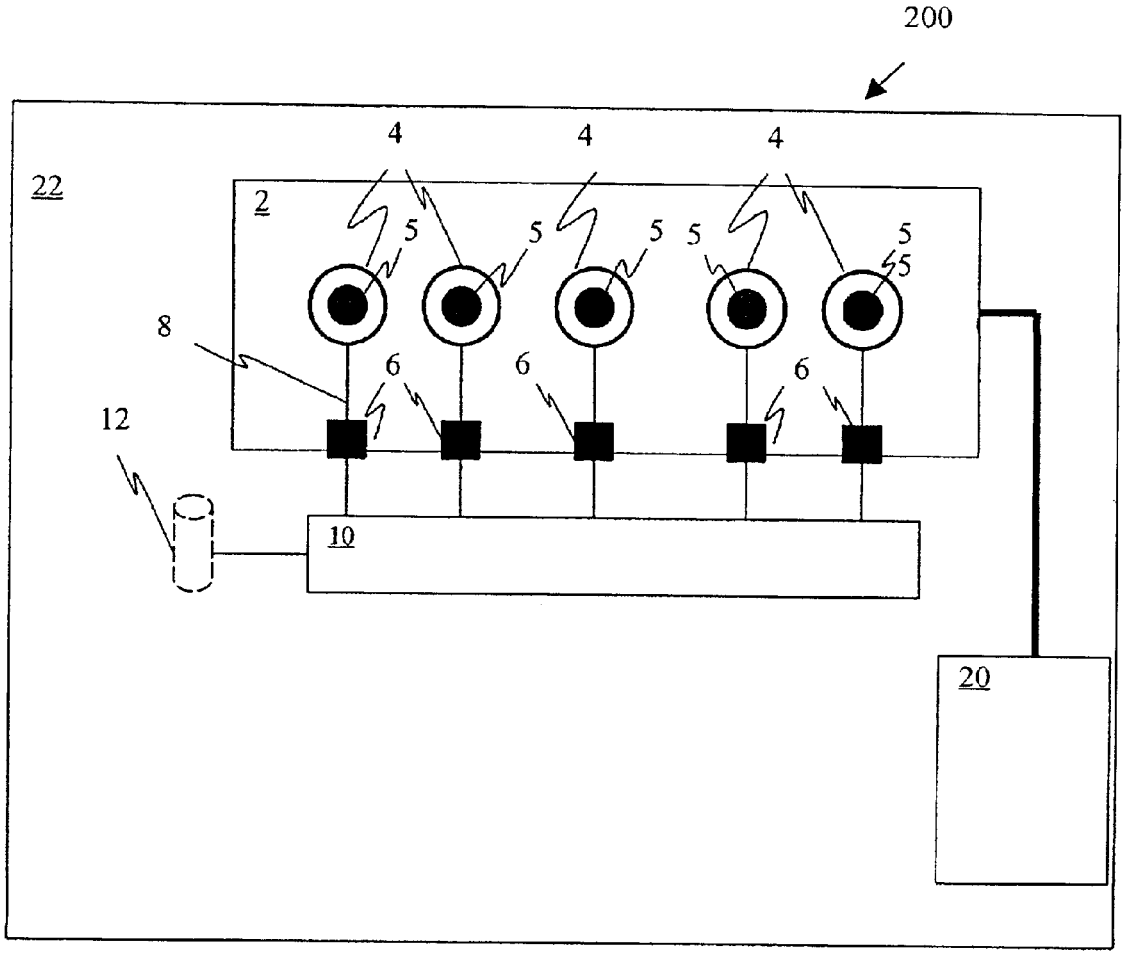
FIG. 8 is a schematic illustration of a modification of the preferred embodiment.
Figure 9:
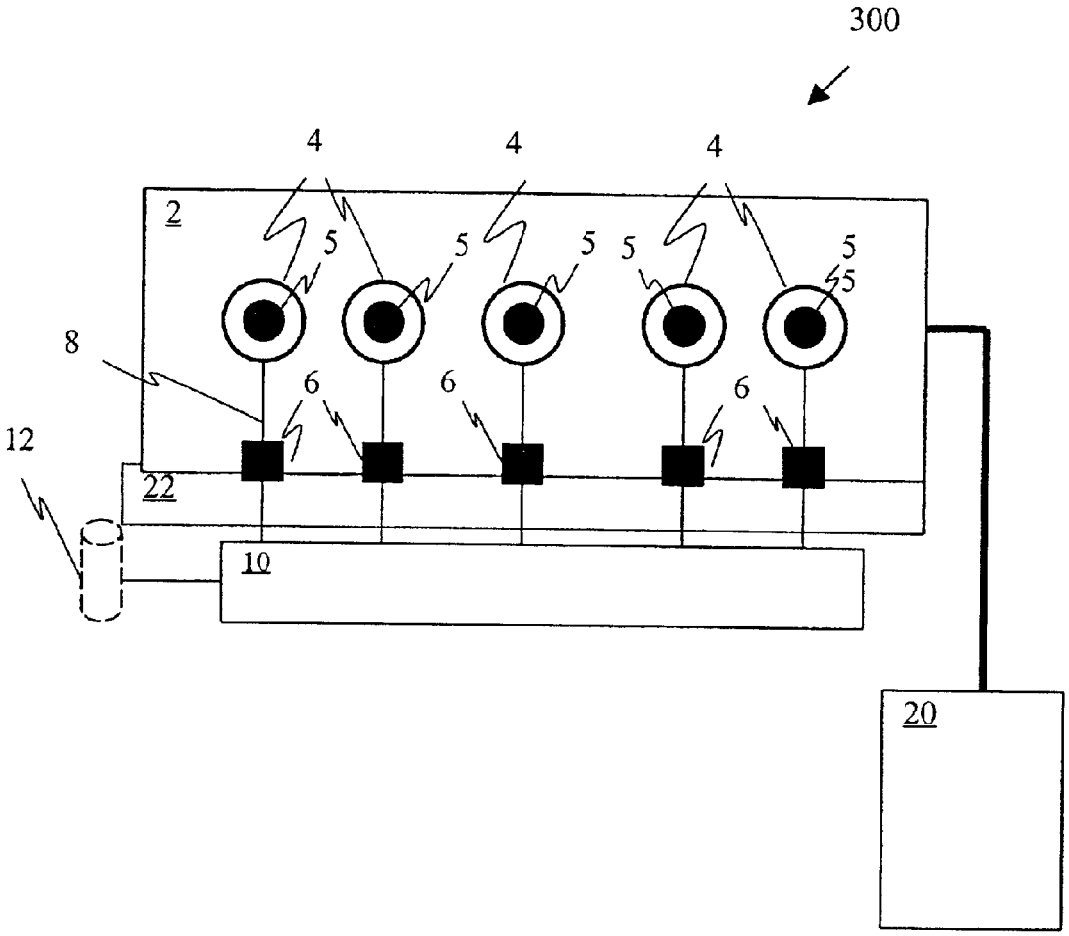
FIG. 9 is a schematic illustration of another modification of the preferred embodiment.
Figure 10:
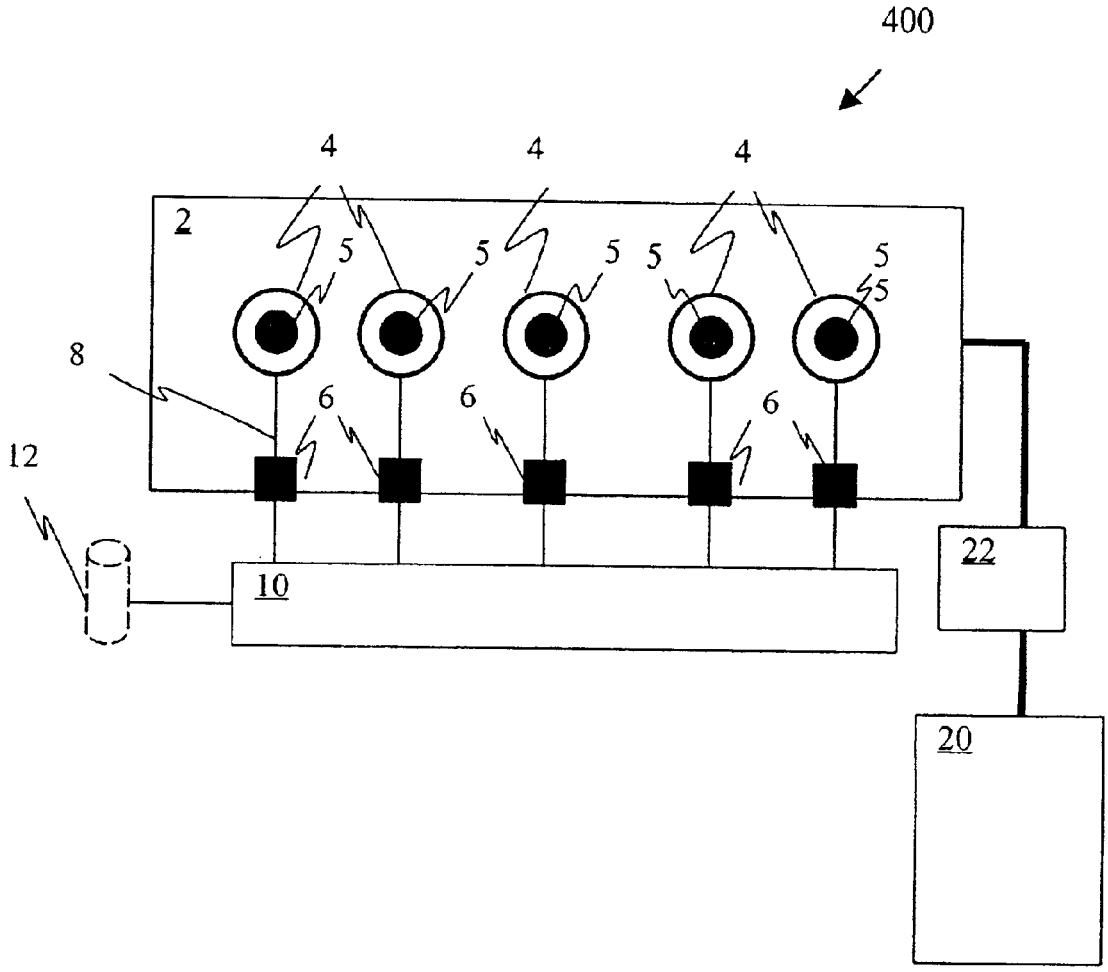
FIG. 10 is a schematic illustration of another modification of the preferred embodiment.

It can be seen that lower ink temperature results in increased deflection angles when using the asymmetrical heating method of deflection. This phenomenon holds true for a wide variety of ink compositions and printhead configurations. Accordingly, the preferred embodiment includes cooling unit 22 disposed proximate ink supply 20 to reduce the ink temperature (see FIG. 1). The ink temperature in ink supply 20 can be reduced to as low as 250K, depending on the ink composition and the freezing point thereof. Applicant has found temperatures as low as to about 290K to produce excellent results. Cooling unit 22 can be disposed at any position to cool ink as it flows to the nozzle. For example, cooling unit 22 can be disposed in or on a reservoir of ink supply 20 as illustrated in FIG. 1, on or around printhead 2 as shown in FIG. 8, proximate an ink passage formed in printhead 2 as illustrated in FIG. 9, in an ink flow line between ink supply 20 and printhead 2 as illustrated in FIG. 10, or at any other appropriate location. Cooling unit 22 can be of any type, such as a heat pump, and can be controlled by controller 10. Temperature sensor 12 can be disposed appropriately to provide feedback control to controller 10 with respect to ink temperature.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

PARTS LIST

2 Print Head
4 Heater
5 Nozzle
6 Contact Pad
8 Conductor
10 Controller
12 Sensor
20 Ink Supply
22 Cooling Unit
30 Reservoir

What is claimed is:

1. A continuous stream ink jet printer, comprising:

a printhead having at least one nozzle having an axis for continuously ejecting a stream of ink droplets;

an ink supply for providing liquid ink to said printhead nozzle;

a heater disposed adjacent to said nozzle, said beater being operative to thermally direct selected ink droplets at an angle with respect to said axis to one of a print medium and a reservoir with unselected ink droplets being directed to the other of the print medium and the reservoir, and a cooling unit for cooling ink provided to said nozzle prior to said ink being ejected from said nozzle.

2. A printer as recited in claim 1, wherein said cooling unit is disposed adjacent said ink supply.

3. A printer as recited in claim 1, wherein said cooling unit is disposed adjacent said printhead.

4. A printer as recited in claim 1, further comprising a supply line conduit coupling said ink supply and said printhead and wherein said cooling unit is coupled to said supply line conduit.

5. A printer as recited in claim 1, wherein said heater is operative to selectively deflect ink droplets off of said axis and into a reservoir and wherein undeflected droplets impinge upon a print medium.

6. A printer as recited in claim 1, wherein said heater comprises at least one heating element which can be selectively activated to heat the ink in an asymmetric manner.

7. A printer as recited in claim 1, wherein said cooling unit is operative to cool the ink to 250K.

8. A printer as recited in claim 1, wherein said cooling unit is operative to cool the ink to 290K.

9. A printer as recited in claim 1, wherein said heater is operative to selectively deflect ink droplets off of said axis to impinge upon said print medium with undelected droplets being directed to said reservoir.

10. A method of printing with a continuous ink jet printer comprising:

cooling ink to a temperature lower than an ambient temperature;

ejecting the ink as a filament out of a nozzle along an axis;

breaking the filament up into droplets; and asymmetrically heating the ink wherein the ink to direct selected droplets off of the axis to one of a print medium and a reservoir with unselected ink droplets being directed to the other of the print medium and the reservoir.

11. A method as recited in claim 10, wherein said cooling step comprises cooling the ink with a cooling unit operatively associated with an ink supply when the ink is in said ink supply.

12. A method as recited in claim 10, wherein said cooling step comprises cooling the ink with a cooling unit operatively associated with a printhead when the ink is in said printhead.

13. A method as recited in claim 10, wherein said cooling step comprises cooling the ink with a cooling unit operatively associated with a supply line conduit when the ink is in said supply line conduit.

14. A method as recited in claim 10, wherein said asymmetrically heating step comprises actuating a heater to selectively deflect ink droplets off of said axis and into a reservoir and wherein undeflected droplets impinge upon a print medium.

15. A method as recited in claim 10, wherein said cooling step comprises cooling the ink to 250K.

16. A method as recited in claim 10, wherein said cooling step comprises cooling the ink to 290K.

17. A method as recited in claim 10, wherein said cooling step occurs prior to said ink being ejected from said nozzle.

18. A method as recited in claim 10, wherein said asymmetrically heating step comprises actuating a heater to selectively deflect ink droplets off of said axis to impinge upon the print medium with undeflected droplets being directed to the reservoir.

19. A continuous stream ink jet printer, comprising:

a printhead having at least one nozzle having an axis for continuously ejecting a stream of ink droplets;

an ink supply for providing liquid ink to said printhead nozzle;

a heater disposed adjacent to said nozzle for thermally deflecting selected ink droplets an angle with respect to said axis to effect a printing operation, and a cooling unit for cooling ink provided to said nozzle prior to said ink being ejected from said nozzle to thereby increase said deflection angle of said droplets, wherein said heater is operative to selectively deflect ink droplets off of said axis and into reservoir and wherein undeflected droplets impinge upon a print medium.

20. A method of printing with a continuous ink jet printer comprising:

cooling ink to a temperature lower than an ambient temperature;

ejecting the ink as a filament out of a nozzle along an axis;

breaking the filament up into droplets; and wherein the ink is asymmetrically heated to selectively deflect the droplets off of the axis and said heater is operative to selectively deflect ink droplets off of said axis and into a reservoir and wherein undeflected droplets impinge upon a print medium.

* * * * *